US008376204B2

(12) United States Patent
Buetow et al.

(10) Patent No.: US 8,376,204 B2
(45) Date of Patent: Feb. 19, 2013

(54) SIDE LOAD MAGAZINE FOR A FASTENER DRIVERS

(75) Inventors: Robert S. Buetow, Lake in the Hills, IL (US); Barry Walthall, Wheeling, IL (US)

(73) Assignee: Illinois Tool Works Inc., Glenview, IL (US)

( * ) Notice: Subject to any disclaimer, the term of this patent is extended or adjusted under 35 U.S.C. 154(b) by 165 days.

(21) Appl. No.: 11/800,282

(22) Filed: May 4, 2007

(65) Prior Publication Data

US 2008/0272168 A1 Nov. 6, 2008

(51) Int. Cl.
*B25C 5/16* (2006.01)

(52) U.S. Cl. ..... 227/120; 227/119; 227/109; 227/136

(58) Field of Classification Search ..... 227/120, 227/109, 119, 136
See application file for complete search history.

(56) References Cited

U.S. PATENT DOCUMENTS

| | | | | | |
|---|---|---|---|---|---|
| 3,272,417 | A * | 9/1966 | Langas et al. | ..... | 227/123 |
| 3,437,250 | A | 4/1969 | Fielder | | |
| 3,946,927 | A * | 3/1976 | Fehrs | ..... | 227/126 |
| 3,980,179 | A * | 9/1976 | Schrepferman | ..... | 206/338 |
| 4,749,115 | A * | 6/1988 | Fehrs | ..... | 227/109 |
| 5,337,995 | A * | 8/1994 | Satoh et al. | ..... | 248/429 |
| 5,433,367 | A | 7/1995 | Liu | | |
| 5,588,577 | A * | 12/1996 | Chen | ..... | 227/120 |
| 5,632,431 | A * | 5/1997 | Lin | ..... | 227/109 |
| 5,653,371 | A * | 8/1997 | Hou | ..... | 227/109 |
| 5,730,350 | A * | 3/1998 | Lin | ..... | 227/120 |
| 5,791,547 | A * | 8/1998 | Yang | ..... | 227/120 |
| 5,794,832 | A * | 8/1998 | Chen | ..... | 227/109 |
| 5,873,509 | A * | 2/1999 | Liao | ..... | 227/109 |
| 6,012,622 | A | 1/2000 | Weinger et al. | | |
| 6,036,072 | A | 3/2000 | Lee | | |
| 6,076,721 | A * | 6/2000 | Yang | ..... | 227/120 |
| 6,290,115 | B1 * | 9/2001 | Chen | ..... | 227/120 |
| 6,651,862 | B2 | 11/2003 | Driscoll et al. | | |
| 6,715,657 | B2 * | 4/2004 | Chen | ..... | 227/120 |
| 6,974,067 | B2 * | 12/2005 | Chen | ..... | 227/120 |
| 7,175,064 | B2 * | 2/2007 | Schell et al. | ..... | 227/120 |
| 7,243,832 | B2 * | 7/2007 | Jiang | ..... | 227/120 |
| 7,284,685 | B1 * | 10/2007 | Wojcicki | ..... | 227/119 |
| 2003/0102351 | A1 * | 6/2003 | Cheng | ..... | 227/120 |
| 2003/0201300 | A1 * | 10/2003 | Chen | ..... | 227/120 |
| 2005/0121488 | A1 * | 6/2005 | Sun | ..... | 227/109 |
| 2006/0049228 | A1 * | 3/2006 | Shen | ..... | 227/120 |
| 2006/0102685 | A1 * | 5/2006 | Phillips et al. | ..... | 227/120 |

* cited by examiner

*Primary Examiner* — Brian D Nash
*Assistant Examiner* — Michelle Lopez
(74) *Attorney, Agent, or Firm* — Greer, Burns & Crain, Ltd.; Patty Chidiac; Mark W. Croll

(57) ABSTRACT

A magazine for a fastener driver includes an inner magazine including a first magazine wall and opposing sidewalls together defining a magazine chamber, and an outer magazine including a second magazine wall slidably engaged relative to the inner magazine to provide access to the chamber. The inner and outer magazines are configured so that at least one strip of fasteners is loadable into the magazine chamber upon the second magazine wall sliding relative to the inner magazine to provide the access.

12 Claims, 4 Drawing Sheets

SIDE LOAD MAGAZINE FOR A FASTENER DRIVERS

BACKGROUND OF THE INVENTION

The present invention relates generally to fastener driving tools, also known as fastener drivers, including automatic staplers, nailers and the like, whether powered electrically, pneumatically, with combustion power, powder or other sources. More specifically, the present invention relates to improvements in magazines used in such tools.

In conventional fastener drivers, especially such tools used in driving relatively thin fasteners such as staples or trim nails, individual fasteners are secured together into strips by adhesive and loaded as a strip into the magazine. To avoid fasteners becoming jammed in the magazine or subsequently in the fastener passageway of the tool, magazines have been designed to retain the fastener strip intact and properly aligned as much as possible. However, fastener jamming and misalignment is still a concern of tool operators and designers.

Another tool design factor is the space required by the magazine in the tool. In some cases, the traditional rear-load or top-load magazines have been found to require excessive space on the tool, or are awkward to load.

Accordingly, there is a need for an improved fastener driver magazine which reduces fastener jamming, facilitates fastener loading and reduces problems associated with fastener misalignment.

BRIEF SUMMARY OF THE INVENTION

The above-listed needs are met or exceeded by the present side load magazine for a fastener driver, which features a sliding side wall of the magazine for enhancing access to a magazine interior chamber. Also, the magazine follower is provided with an alignment formation slidingly and matingly engaged on a magazine wall to maintain aligned engagement with the fasteners once they are properly loaded. In addition, the present magazine is provided with an anvil which extends less than the full length of the magazine for facilitating loading of fastener strips.

More specifically, the present magazine includes a magazine for a fastener driver, including an inner magazine including a first magazine wall and opposing sidewalls together defining a magazine chamber, and an outer magazine including a second magazine wall slidably engaged relative to the inner magazine to provide access to the chamber. The inner and outer magazines are configured so that at least one strip of fasteners is loadable into the magazine chamber upon the second magazine wall sliding relative to the inner magazine to provide the access.

In another embodiment, a magazine for a fastener driver is provided and includes an inner magazine including a first magazine wall and opposing sidewalls together defining a magazine chamber, and an outer magazine including a second magazine wall operationally associated with the inner magazine to close the magazine chamber. A magazine follower is disposed on one of the first and second magazine walls, and includes a guide formation slidingly engaging a guide on the associated wall for maintaining alignment of the follower relative to the magazine chamber.

DETAILED DESCRIPTION OF THE INVENTION

Figure 1:
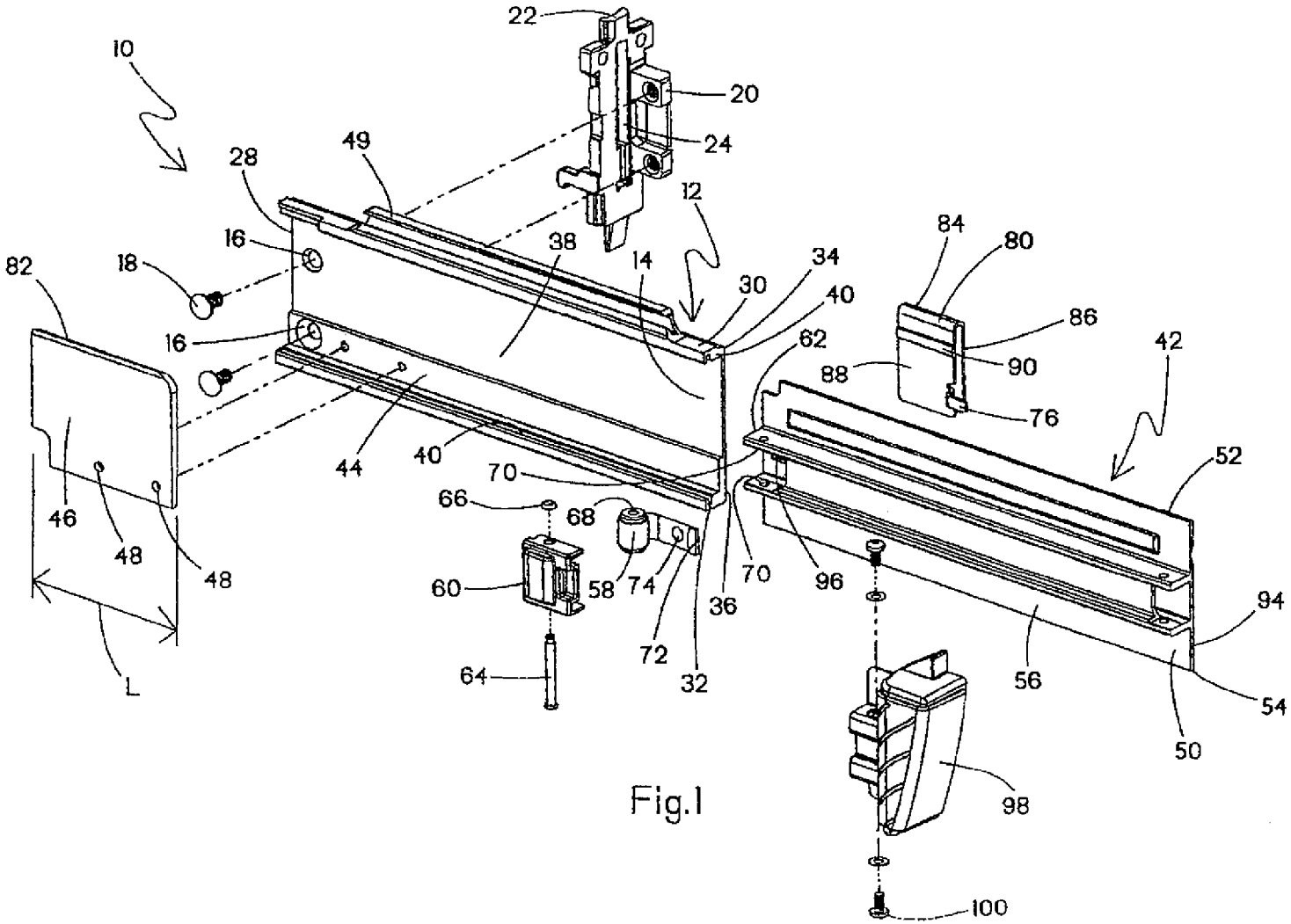
FIG. 1 is an exploded perspective view of the present magazine.

Referring now to FIG. 1, the present magazine is generally designated 10, and is designed for use in a powered fastener driver of the type known in the art and designed for use in applying fasteners sequentially into a workpiece from such a magazine. Such fastener driver tools are powered in various ways, whether electronically, pneumatically, using combustion power, powder activated, or otherwise powered. Exemplary combustion tools are described in U.S. Pat. Nos. 6,012,622 and 6,651,862, which are incorporated by reference. The fasteners retained in the magazine are typically secured to each other by adhesive, paper strips, plastic carrier strips or the like as is well known in the art. In the present application, the type of fastener most preferred in the present magazine is an inverted "U"-shaped staple or a trim type fastener in which adjacent fasteners are secured to each other with adhesive. However it is to be understood that the present magazine 10 may be used with other types of fasteners depending on the application.

Referring now to FIG. 1, the present magazine 10 includes an inner magazine 12 which is typically secured to a portion of the fastener tool as is well known in the art. A first magazine wall 14 is provided with at least one mounting aperture 16 receiving fasteners 18 for securing the wall to a back plate 20 of a fastener nosepiece 22 as is well known in the art. The nosepiece 22 includes a fastener slot 24 dimensioned for receiving fasteners 26 (FIG. 5) fed sequentially through an outlet 28 of the magazine 10.

Figure 3:
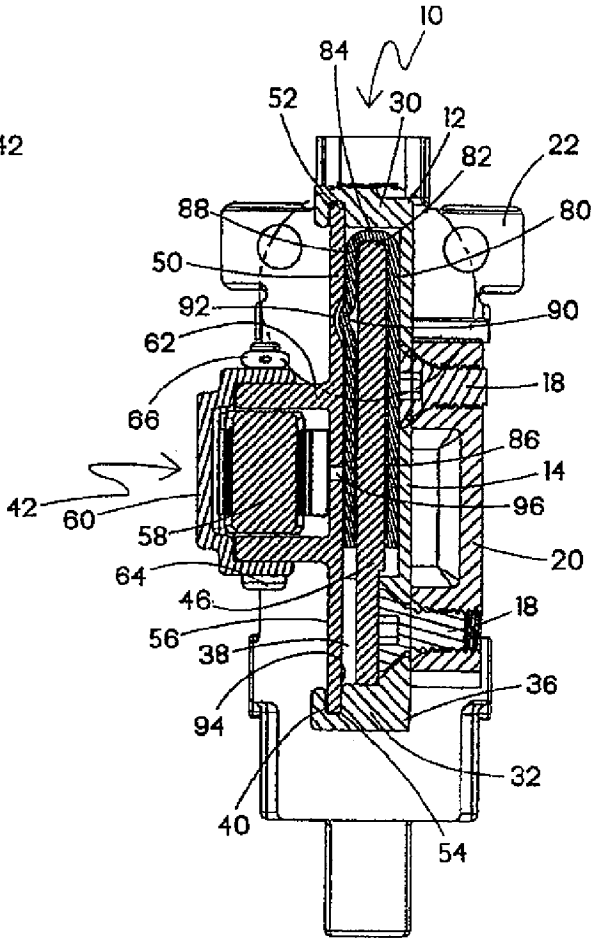
FIG. 3 is a vertical section taken along the line 3-3 of FIG. 2 and in the direction indicated.
Figure 4:
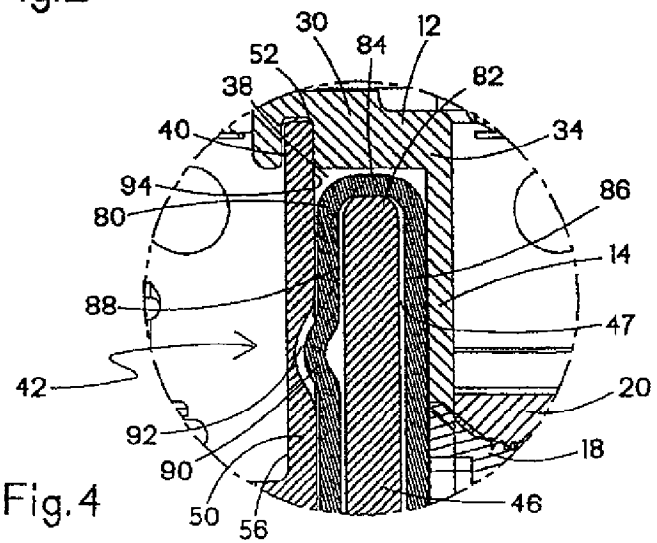
FIG. 4 is a fragmentary enlarged cross-section of FIG. 3.

Referring now to FIGS. 1, 3 and 4, preferably integrally joined or formed to the first magazine wall 14, a pair of opposing sidewalls 30, 32 project generally normally from upper and lower edges 34, 36 of the first wall to form a generally "[]"-shaped structure defining a magazine chamber 38. The magazine chamber 38 is configured for storing at least one strip of fasteners 26 (here staples) and is in communication with the outlet 28 and the fastener slot 24. Each of the sidewalls 30, 32 also is provided with an elongate groove 40 for slidingly receiving an outer magazine 42 as will be discussed further below.

Adjacent the lower sidewall 32 (referring to the orientation of the magazine 10 as shown in FIG. 1, which may change during tool operation) is provided a standoff wall 44 to which is mounted a generally planar anvil 46 using mounting apertures 48 and suitable fasteners; however other fastening techniques, such as welding, chemical adhesive and the like are contemplated. Upon assembly to the standoff wall 44, a space 47 (FIG. 4) is defined between the first wall 14 and the anvil 46 for slidably accommodating one leg of the staples 26.

A feature of the present magazine 10 is that the anvil 46 does not extend the full length of the magazine 10 or even the magazine chamber 38. In the preferred embodiment, the anvil 46 has a length "L" which is approximately one-third the length of the magazine chamber 38. Also, the anvil 46 is preferably mounted at the front of the first magazine wall 14 near the outlet 28. This configuration is employed to facilitate side loading of the fasteners 26 into the magazine 10, but other mounting locations are contemplated. A mounting bracket 49 is located along the upper sidewall 30 for further securing the magazine 10 to the tool. It is to be understood that the configuration and/or placement of the bracket 49 may change to suit the particular tool. Also, in some tools, the bracket 49 is absent.

The outer magazine 42 includes a second magazine wall 50 having opposed elongate edges 52, 54 slidingly received in the elongate sidewall grooves 40 in the inner magazine 12. Thus, the relative sliding movement of the outer magazine 42 relative to the inner magazine 12 opens or closes the magazine chamber 38 as is needed to load the fasteners 26. A feature of the present magazine 10 is that the fasteners 26 are loaded into the magazine chamber 38 from the side, rather than from the top or rear as is known in the art. This loading arrangement has been found to be particularly beneficial in fastener drivers where space is restricted. It is contemplated that the outer magazine 42 may slide relative to the inner magazine 12, or the reverse, depending on the situation.

An outer surface 56 of the second magazine wall 50 accommodates a follower return spring 58 having a spring cover 60, both of which are secured to a bracket 62 on the outer surface by a pin 64 and a spring clip 66. As is known in conventional magazines, the pin 64 passes through the spring cover 60, through a throughbore 68 in the follower spring 58 and through openings 70 in the bracket 62. The follower spring 58 is wound in a coil, and a free end 72 has a hole 74 for engagement by a prong 76 located on a follower 80.

Referring now to FIGS. 1-4, the follower 80 is slidably disposed on one of the first and second walls 14, 50 and is constructed and arranged for urging at least one strip of fasteners 26 toward the magazine outlet 28. While other shapes are contemplated, depending on the application, the follower 80 is provided in a generally inverted "U" shape when viewed in cross-section (FIG. 4) and is dimensioned to slidably engage an upper edge 82 of the anvil 46. Also seen in FIG. 4, the assembly of the anvil 46 in the magazine chamber 38 and the closing off of the chamber by the outer magazine 42 defines an inverted "U"-shaped area for receiving the follower 80.

More specifically, the follower 80 includes a crown or apex 84, a first leg 86 and a second leg 88. The first and second legs 86, 88 are generally parallel to each other and extend along the anvil 46. There is a slidable clearance in the magazine chamber 38 between anvil 46 and the first wall 14 for the leg 86, and between the anvil and the second wall 50 for the second leg 88.

Figure 2:
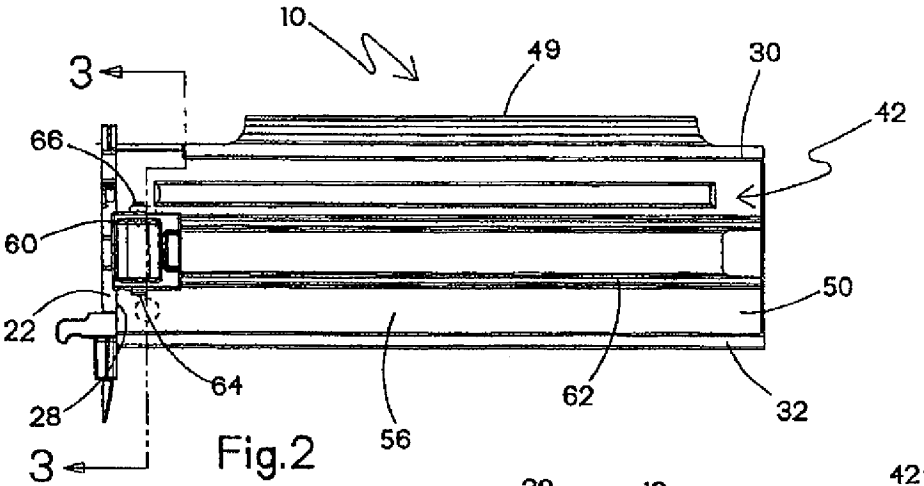
FIG. 2 is a fragmentary side elevation of the present magazine.

Referring now to FIGS. 1, 3 and 4, another feature of the present magazine 10 is that the alignment of the follower 80 in the magazine chamber 38 and relative to the anvil 46 and the fasteners 26 is maintained to prevent fastener jams and to promote tool efficiency. More specifically, a guide formation 90 is provided on the follower 80 and a complementary guide 92 is provided on the magazine 10 for maintaining follower alignment. The guide formation is preferably a convex, elongate portion of the second follower leg 88, and the guide 92 preferably takes the form of an elongate, concave groove or track on an inner surface 94 of the second magazine wall 50. As such, the guide 92 is not visible from the outside of the magazine (FIG. 2). Thus, the guide formation 90 is slidably and complementarily received in the guide 92 to maintain alignment of the follower 80 relative to the magazine wall 14. It is contemplated that the guide formation 90 is alternately concave and the guide 92 is convex. Also, while the follower 80 and the guide formation are associated with the second magazine wall 50, it is also contemplated that they may be associated with the first magazine wall 14 depending on the application.

As is known in the magazine art, the follower 80 is biased toward the outlet 28 by the follower return spring 58. The free end of the spring 72 is fed through a slot 96 in the second magazine wall 50 so that the prong 76, which extends opposite the outlet 28, positively engages the hole 74.

Figure 5:
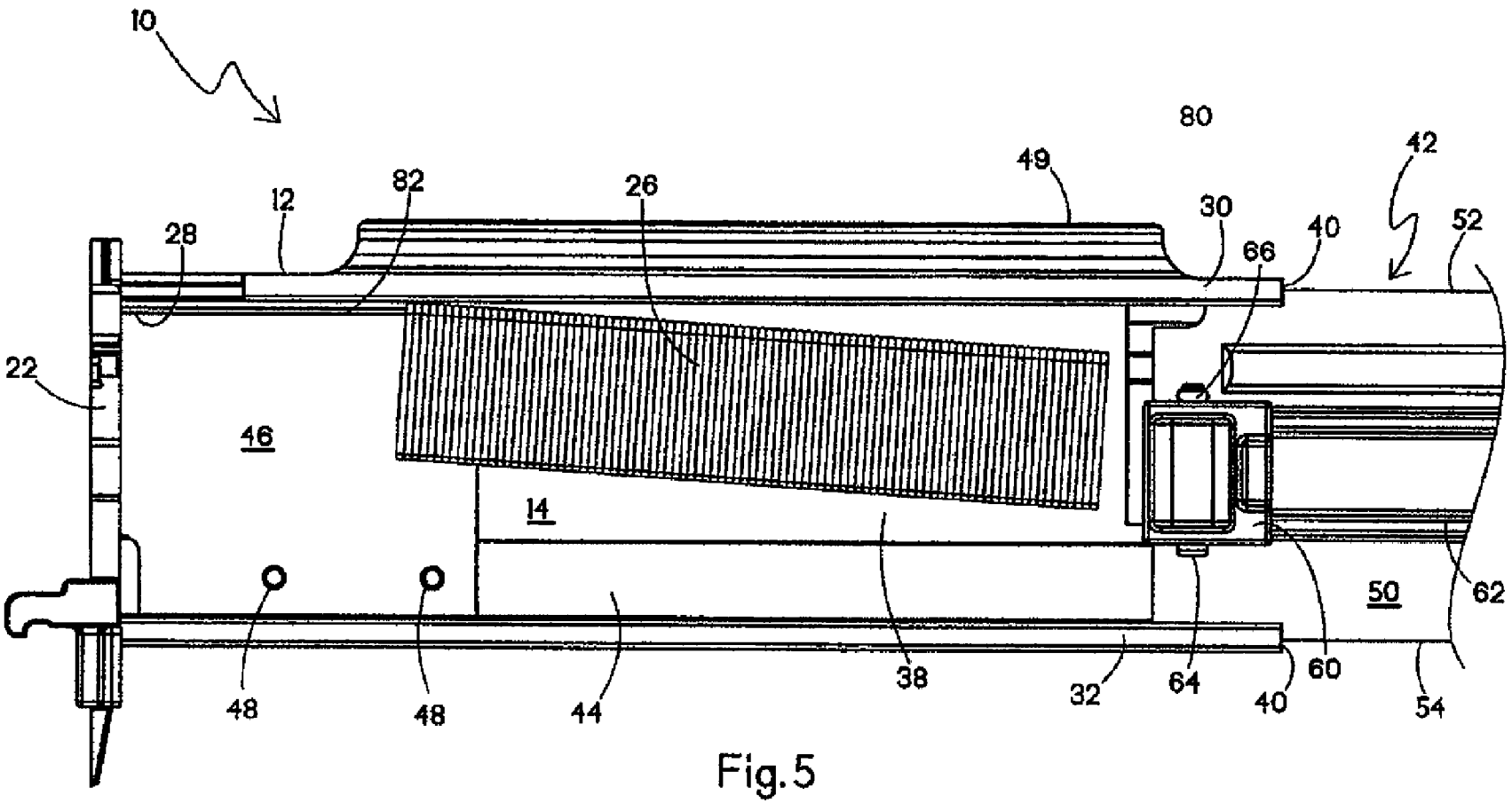
FIG. 5 is a side elevation of the present magazine in a fully open, first fastener strip load position.
Figure 6:
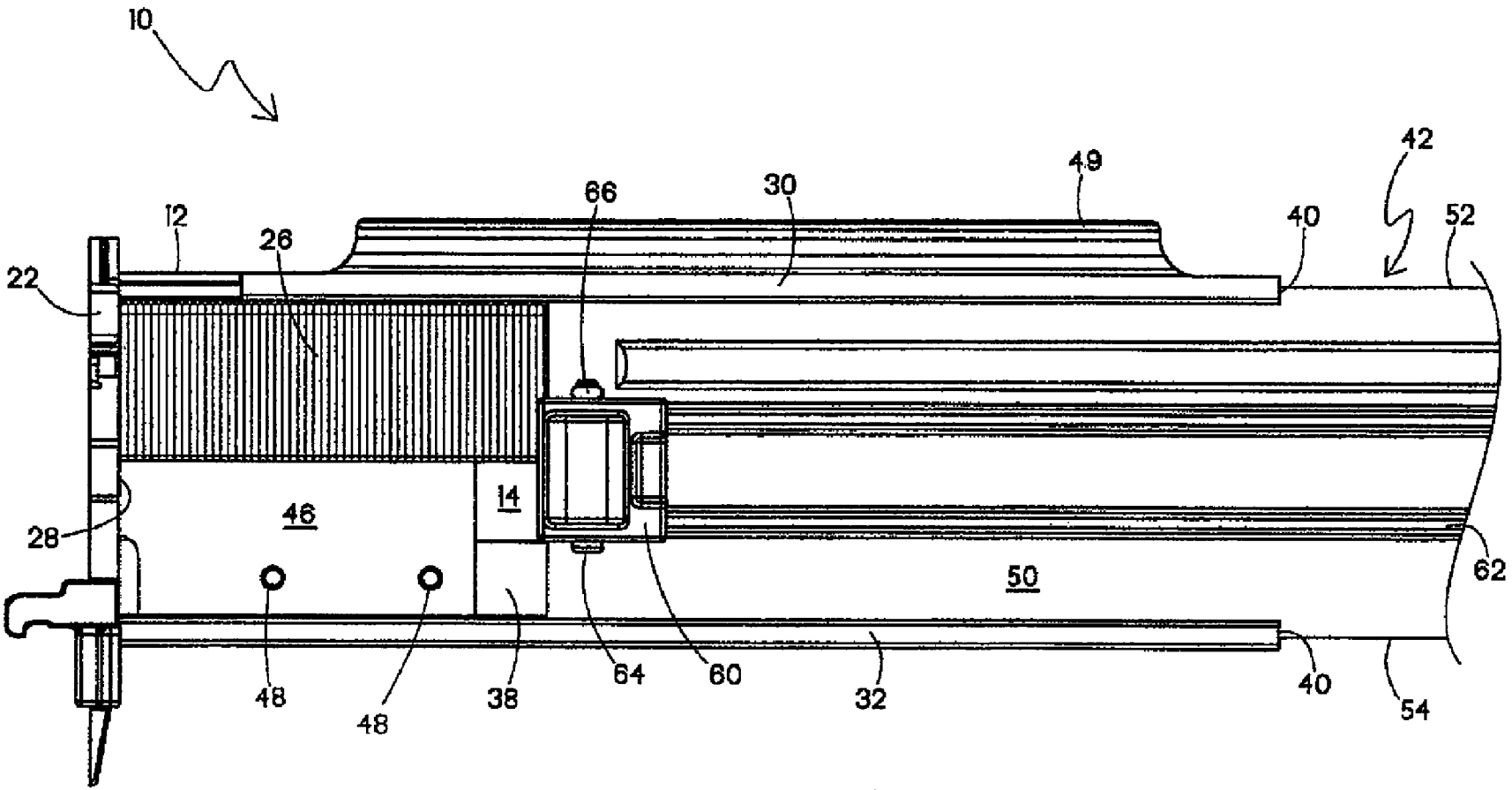
FIG. 6 is a side elevation of the present magazine in a partially closed, second fastener strip load position.

Referring now to FIGS. 5 and 6, the magazine 10 is shown respectively in the open and partially closed positions. In FIG. 5, the outer magazine 42 is completely open so that the fasteners 26 have access to, and can be inserted into the magazine chamber 38. Only one strip of fasteners 26 is shown being installed, but it is contemplated that additional strips may be loaded into the magazine, depending on the application, the size of the magazine 10, and the length of the anvil 46. To easily side load the fasteners 26, the strip is placed on an incline or angle as the anvil 46 is engaged by positioning the fasteners over the upper edge 82 of the anvil. Then, referring to FIG. 6, as the outer magazine 42 is closed and moved toward the outlet 28, the follower 80 engages the fasteners 26 and properly aligns them upon the anvil 46, while urging them toward the outlet.

Referring now to FIG. 2, the outer magazine 42 is fully closed, and the position of the follower return spring 58 being closer to the outlet 28 than the follower 80, increases the biasing force exerted by the follower upon the fasteners 26. Assembly of the magazine 10 is completed by securing an endcap 98 (FIG. 1) to the outer magazine 42 at the end opposite the outlet 28 using fasteners 100, preferably but not exclusively screws.

While a particular embodiment of the present side load magazine for fastener drivers has been described herein, it will be appreciated by those skilled in the art that changes and modifications may be made thereto without departing from the invention in its broader aspects and as set forth in the following claims.

The invention claimed is:

1. A magazine for a fastener driver, comprising:

an inner magazine including a front end and a rear end, and a first magazine wall and opposing sidewalls together defining a magazine chamber, said first magazine wall including a standoff wall extending outwardly a designated distance from said first magazine wall;

an outer magazine including a front end, a rear end, and a second magazine wall slidably engaged to said inner magazine, said outer magazine and said inner magazine defining a side opening between said front end of said inner magazine and said front end of said outer magazine upon said second magazine wall sliding relative to said inner magazine for providing side access to said chamber;

said inner and outer magazine being configured so that at least one strip of fasteners including multiple fasteners temporarily secured together is loadable into said magazine chamber from said side opening;

a fastener support including an anvil removably secured within said magazine chamber to said standoff wall so that said anvil is spaced said designated distance from said first magazine wall to accommodate at least a portion of said fasteners, said anvil having a sufficient length to support and provide a sliding surface for multiple fasteners in said at least one strip of fasteners, said fastener support extending less than a full length of said chamber thereby defining a space between an end of said fastener support and a corresponding end of said magazine chamber for facilitating angle loading of said at least one strip of fasteners into said magazine from said side opening so that the fasteners are inserted in a direction generally normal to a longitudinal axis of said inner magazine;

a magazine follower slidably engaged with one of said first and second walls and constructed and arranged for urging the at least one strip of fasteners toward an outlet of said magazine; and a guide formation formed on said follower and a complementary guide on a surface of said wall for maintaining sliding alignment of said follower relative to said magazine wall.

2. The magazine of claim 1 wherein said anvil is secured to a front end of said first magazine wall.

3. The magazine of claim 1 wherein said guide formation is a convex, elongate portion of a sidewall of said follower, and said complementary guide is an elongate track on said magazine.

4. The magazine of claim 1 wherein said guide is an elongate groove on an inner surface of said second magazine wall of said outer magazine, said guide formation directly engaging said guide.

5. The magazine of claim 4 wherein said guide is located on an inside surface of said second wall and is not visible from an outside surface of said wall.

6. The magazine of claim 4 further including a follower return spring on said outer magazine.

7. The magazine of claim 1 further including a generally planar anvil disposed in said magazine chamber such that upon assembly, said outer and inner magazine and said anvil define an inverted "U"-shaped area for slidingly receiving and guiding fasteners inserted into said magazine.

8. A magazine for a fastener driver, comprising:

an inner magazine including a front end and a rear end, and a first magazine wall and opposing sidewalls together defining a magazine chamber;

an outer magazine including a front end, a rear end, and a second magazine wall operationally associated with said inner magazine to close said magazine chamber, said outer magazine and said inner magazine defining a side opening between said front end of said inner magazine and said front end of said outer magazine upon said second magazine wall sliding relative to said inner magazine for loading a fastener strip from said side opening, said fastener including multiple fasteners temporarily secured together;

a fastener support including an independent anvil removably secured to said inner magazine wall, said fastener support being constructed and arranged to have a length substantially less than a length of said magazine chamber thereby defining a space between an end of said fastener support and a corresponding end of said magazine chamber, yet sufficiently long to slidingly support said fastener strip, said anvil being substantially parallel to and spaced a designated distance from said first magazine wall to accommodate a first portion of said fastener strip loaded from said side opening, a second portion of said fastener strip being supported by said second magazine wall; and a magazine follower disposed on one of said first and second magazine walls, said follower including an integral convex guide formation slidingly engaging a guide slot on an inside surface of said associated wall for maintaining direct, sliding alignment of said follower relative to said wall.

9. The magazine of claim 8 wherein said inner and said outer magazine are configured so that the fastener strip is loadable into said magazine chamber from said side opening so that the fastener strip is inserted in a direction generally normal to a longitudinal axis of said inner magazine upon said second magazine wall sliding relative to said inner magazine to provide access to said chamber.

10. The magazine of claim 9 wherein said anvil is disposed in said magazine chamber such that upon said second magazine wall sliding to provide access to said chamber through said side opening, the fastener strip is placed into the chamber, inclined, placed over said anvil and said follower urges the strip upon said anvil and toward an outlet end of said magazine upon closing of said chamber by said second magazine wall.

11. The magazine of claim 8 further including a follower return spring on one of said first and second magazine walls, and said follower is provided with a prong for engaging an end of said spring.

12. A magazine for a fastener driver configured for driving fasteners into a workpiece, comprising:

an inner magazine including a front end and a rear end, and a first magazine wall and opposing sidewalls together defining a magazine chamber;

an outer magazine including a front end, a rear end and a second magazine wall slidably engaged to said inner magazine to provide access to said chamber, said outer magazine and said inner magazine defining a side opening between said front end of said inner magazine and said front end of said outer magazine upon said second magazine wall sliding relative to said inner magazine;

said inner and outer magazines being configured so that at least one strip of fasteners is loadable into said magazine chamber from said side opening;

a fastener support including an independent anvil nonmovably secured within said magazine chamber to one of said inner magazine and said outer magazine, said fastener support having a sufficient length to support a first portion of said at least one strip of fasteners and extending less than a full length of said chamber thereby defining a space between an end of said fastener support and a corresponding end of said magazine chamber for facilitating angle loading of said at least one strip of fasteners into said magazine from said side opening so that the fasteners are inserted in a direction generally normal to a longitudinal axis of said inner magazine, a second portion of said at least one strip of fasteners being supported by said second magazine wall;

a magazine follower disposed on one of said first and second magazine walls, said follower having an integral guide formation slidingly engaging a complementary guide on said associated wall for maintaining sliding alignment of said follower relative to said magazine chamber; and a return spring mounted on said magazine and being connected to said magazine follower for urging said follower towards a tool nosepiece, said return spring disposed on said magazine independently of said guide formation and said guide.

* * * * *